US005184947A

United States Patent [19]

Coombe

[11] Patent Number: 5,184,947

[45] Date of Patent: Feb. 9, 1993

[54] FULLY VARIABLE OUTPUT HYDRAULIC GEAR PUMP HAVING AN AXIALLY TRANSLATABLE GEAR

[76] Inventor: Dwight Coombe, 40 S. Hill Rd., Grahamsville, N.Y. 12740

[21] Appl. No.: 703,364

[22] Filed: May 21, 1991

[51] Int. Cl.[5] ..... F04C 2/18; F04C 11/00; F04C 15/04

[52] U.S. Cl. ..... 418/20; 418/21; 418/22

[58] Field of Search ..... 418/20-22, 418/28

[56] References Cited

U.S. PATENT DOCUMENTS

| | | | |
|---|---|---|---|
| 815,522 | 3/1906 | Fraser | 418/21 |
| 2,052,419 | 8/1936 | Moore et al. | 418/21 |
| 2,258,504 | 10/1941 | Booth | 418/21 |
| 2,955,541 | 5/1957 | Moore | 418/21 |
| 3,110,265 | 11/1963 | Miller | 418/21 |
| 3,588,295 | 6/1971 | Burk | 418/21 |
| 3,669,577 | 6/1972 | Swanson | 418/21 |
| 3,873,241 | 1/1975 | Motomura | 417/283 |
| 4,740,142 | 4/1988 | Rohs et al. | 418/21 |
| 4,872,536 | 10/1989 | Yue | 188/290 |
| 4,932,504 | 6/1990 | Zheng | 188/290 |

FOREIGN PATENT DOCUMENTS

| | | | |
|---|---|---|---|
| 2327556 | 2/1975 | Fed. Rep. of Germany | 418/21 |
| 1541410 | 2/1990 | U.S.S.R. | 418/21 |

*Primary Examiner*—John J. Vrablik
*Attorney, Agent, or Firm*—Heslin & Rothenberg

[57] ABSTRACT

A fully variable output hydraulic pump includes a main casing having a fluid pumping chamber extending therethrough, fluid input ports and fluid output ports. The fluid pumping chamber is shaped to receive a pair of cylindrically shaped gears inserted axially therethrough. A first rotatable gear and second rotatable gear are insertable through the pumping chamber. The first and second gears are rotatably supported by respective means which are axially translatable relative to each other. A means for sealing the area between the gears and the main casing effectively creates a sealed fluid pumping chamber. By translating one of said means for rotatably supporting the gears, the effective fluid pumping volume within the fluid pumping chamber may be altered to provide a fully variable output hydraulic pump.

16 Claims, 6 Drawing Sheets

FULLY VARIABLE OUTPUT HYDRAULIC GEAR PUMP HAVING AN AXIALLY TRANSLATABLE GEAR

BACKGROUND OF THE INVENTION

This invention relates to the field of hydraulic transmission systems such as hydraulic pumps, motors, transmissions and torque convertors. More particularly, the invention relates to a fully variable output hydraulic pump.

Typically, variable capacity pumps or motors include reciprocal pumps and single action rotary vane type pumps which are capable of varying the flowrate of hydraulic fluid pumped therethrough. These types of hydraulic pumps are used for pumping oil under pressure for various applications such as power equipment, farm equipment, mobile equipment and other types of equipment where hydraulic motors and cylinders may be used. Typically, the output of the oil of the pump is varied by varying the input power to the pump, thereby varying the rotation of a rotary vane type pump or increasing the rate of reciprocation of a plunger type pump. Also, the pump's capacity can be varied by moving certain parts in relation to other parts. The problem with these pumps when used as transmission systems, torque convertors or motors is that they operate at optimum efficiency only for a narrow range of input speeds.

In order to vary the output of a pump, it is possible to either increase the speed or power input to the pump or increase the pump's volumetric capacity. Variable outlet pumps which operate by varying the pump's volumetric capacity by varying the axial position of rotary gears are known in the art. However, these variable output pumps suffer from certain deficiencies. For example, these pumps often have dead spaces where hydraulic fluid becomes trapped causing a back pressure within the pump which adversely affects pump efficiency. Also, the sealing systems, utilized within the pump are often inadequate causing loss of pump pressure.

It is therefore an object of the present invention to provide a variable output pump which may vary the pump's fluid pumping capacity by varying the axial position of rotary gears thereby increasing the volume of fluid pumped therethrough.

It is a further object of the present invention to provide a fully variable hydraulic pump which may operate at maximum efficiency and provide optimum power throughout a wide range of input power speeds.

It is yet another object of the present invention to provide a fully variable output hydraulic pump which is simplier in design and capable of being manufactured in a cost effective manner.

It is yet another object of the present invention to provide a basic torque conversion or transmission system which employs a fully variable hydraulic pump or motor.

It is yet another object of the present invention to provide a transmission system or torque convertor which employs a fully variable output hydraulic pump or motor which may be suitable for use in vehicles or mobile equipment.

SUMMARY OF THE INVENTION

The aforementioned objects and advantages of the invention may be achieved through implementation of a fully variable output hydraulic pump in accordance with the present invention.

The pump includes a main casing having a fluid pumping chamber extending therethrough, a first and a second rotatable gear which are insertable through the fluid pumping chamber of the main casing when meshed, means for rotatably supporting the first gear, means for rotatably supporting the second gear, means for sealing the area between each of the gears and the main casing, means for translating the second gear, and means for supporting the second gear. The means for supporting the second gear is axially translatable relative to the means for supporting the first gear. The means for rotatably supporting the first gear may include an outer casing having one or more bearing means engaged thereto. The means for sealing the area between each of the gears and the main casing may include a gear sleeve means configured to allow one of the rotatable gears to be axially insertable therein. The first gear may be inserted within a first gear sleeve and the second gear inserted within a second gear sleeve.

The first gear sleeve may have a plurality of finger members extending axially therefrom; the finger members are insertable between the teeth of the first gear. The means for rotatably supporting the second gear may include a block member having a bearing means therein for supporting the second gear. The block member may be insertable within the main casing of the fluid pumping chamber and a lower concave surface of a diameter complimentary to the diameter of the first gear such that the lower surface of the block member is mounted upon the first gear. The means for rotatably supporting the first gear may comprise an end plate mountable to the outer casing. The end plate may be capable of receiving the second gear sleeve therein and the second gear sleeve may have the second gear inserted therethrough such that the second gear sleeve and second gear rotatable relative to the end plate. The means for rotatably supporting the second gear may further comprise an outer support assembly having a bearing means engaged thereto.

The pump may further comprise a third rotatable gear mounted to rotate synchronously with the first gear. The third gear is in mesh with the second gear to continuously drive the second gear synchronously. The pump may further comprise a second casing having a fluid pumping chamber extending therethrough and having a fluid input port and fluid output port. The third and second gears may be mesh inserted through the second casing. The pump may further comprise means for sealing fluid within the second casing. The means for sealing fluid within the second casing may comprise a third gear sleeve rotatably mounted within the second end plate. The second and third gear sleeves are rotatably mounted within the second end plate. The second and/or third gear sleeve may comprise a ring member having a tooth pattern on its inner diameter, the tooth pattern being complimentary to the teeth of the second gear wherein the second gear is in close tolerance with the second gear sleeve when inserted therein.

DETAILED DESCRIPTION

Figure 1:
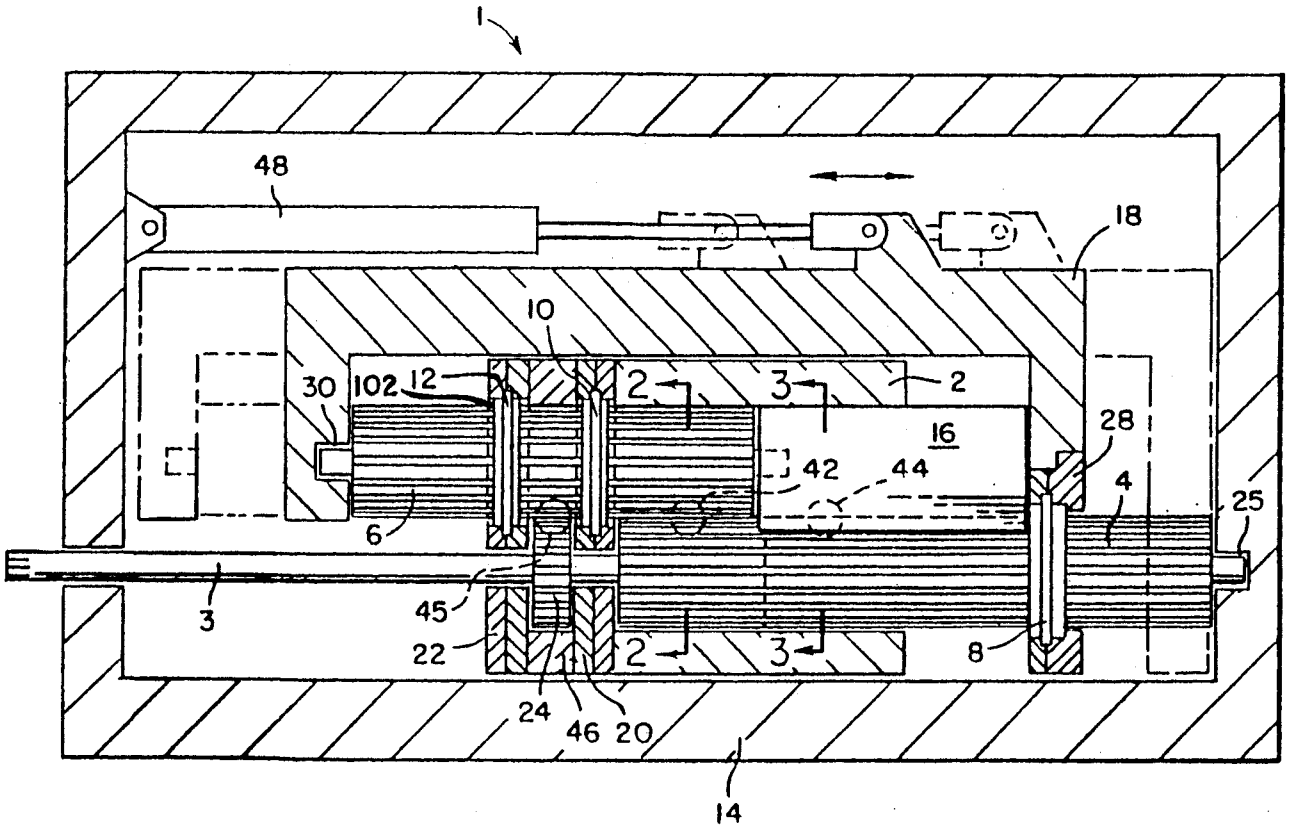
FIG. 1 depicts a longitudinal sectional view of the variable output hydraulic pump in accordance with the present invention.

The fully variable output hydraulic pump 1 contains a main casing 2, a first gear 4, a second gear 6, gear sleeves 8, 10, 12, outer casing 14, block member 16, outer support assembly 18 and end plates 20, 22.

Referring now to FIG. 1, the first gear 4 is supported at its first end by a bearing 25 within an outer casing 14. At the second end of the first gear 4, the gear shaft 3 is supported by a first end plate 20 and second end plate 22. The shaft 3 extends through the outer casing 14 to be driven by a power means. The end plates contain a bearing enabling the shaft 3 connected to the first gear 4 to rotate. As shown in FIG. 1, the first gear is inserted through a gear sleeve 8 having a plurality of fingers 26 (shown in FIG. 5A) which extend therefrom. The gear sleeve 8 is inserted into a bearing support assembly 28 which enables the gear sleeve 8 to rotate therein. The bearing support assembly 28 is affixed to an outer support assembly 18. The outer support assembly 18 contains a bearing means 30 therein located at a position where the first end of a second rotatable gear 6 is located. The opposite end of the second gear is supported within a block 16 shaped as a cylinder type member. The second gear 6 is inserted through a second gear sleeve 10 and a third gear sleeve 12 which are mounted within the second end plate 22 and first end plate 20, respectively, such that each gear sleeve is rotatable within its corresponding end plate.

Figure 2:
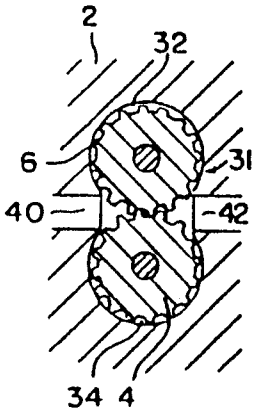
FIG. 2 depicts a portion of the fully variable output hydraulic pump shown in FIG. 1 taken along line 2—2.
Figure 3:
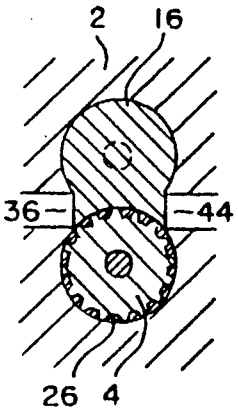
FIG. 3 depicts a portion of the fully variable output hydraulic pump shown in FIG. 1 taken along line 3—3.

Referring to FIGS. 2 and 3, the second gear 6 and block member 16 are insertable through one side 32 of an opening 31 extending through the main casing 2. The first gear is inserted through the second side 34 of the opening 31 of the main casing 2 such that the teeth of the first and second gear mesh within the opening 31 and the fingers 26 of the first gear sleeve 8 are in close tolerance with the underside of the block member 16.

The first and second gear may be sized according to the pumping requirements of the hydraulic pump as defined by the pumping volume within the main casing. As shown in FIGS. 2 and 3, the teeth of the first and second gears are in very close tolerance to the inner wall of the main casing 2. The clearance between the teeth and wall should be sufficient to allow hydraulic fluid to be pumped by the gear teeth along the inner wall. Typical tolerances would depend upon the particular materials used in construction of the pump and its components. Typical materials would include cast iron; cast aluminum; various alloys of steel, aluminum and cast iron. However, other suitable materials may be used. The main casing is similar in design to a standard hydraulic casing. The opening 31 may be made by boring two holes defining ends 32 and 34 as depicted in FIG. 2. The opening 31 extends throughout the length of the casing. Input ports 40, 36, shown in FIGS. 2 and 3 allow hydraulic fluid to be drawn into the pumping chamber formed by opening 31. Outlet ports 42 and 44, are formed by apertures which extend transversely through the main casing 2 from the opening 31 to the outside of the casing opposite from the inlet ports 40, 36.

Referring again to FIG. 1, a third gear 24 is connected to shaft 3 between the first end plate 20 and the second end plate 22 such that the third gear rotates synchronously with the first gear. The teeth of the third gear 24 also mesh with the teeth of the second gear 6 at a position between the second gear sleeve 10 and third gear sleeve 12. Both the third and second gears are inserted through a second casing 46.

The second casing 46 is similar in shape and construction to main casing 2 and includes an opening therethrough similar in shape to the opening 31 of main casing 2 depicted in FIG. 2. The second casing 46 is axially shorter in length and contains an input port 45 formed by an aperture extending through a first side of the second casing 46 into the opening through the center thereof. An output port, leads from the opening in the center of the second casing 46 to the opposite side of the casing to allow fluid to enter through the input port 45 and exit through the output port.

The outer support assembly 18 is connected to a means for axially translating the outer support assembly 18 relative to the outer casing 14. This means may include a hydraulic cylinder 48. However, other suitable means and mechanisms such as levers, gear systems, linkages, etc., may also be used.

The shaft 3 contains a splined, squared or keyed end which may be driven by a power means such as an engine. The shaft and gears may be supported by journal bearings as shown in FIG. 1, however, other equivalent bearing means which are well known in the art may also be used.

Figure 4B:
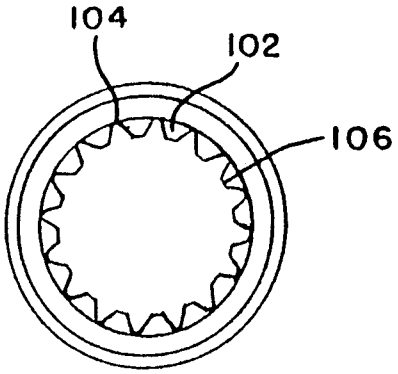
FIGS. 4A and 4B depict a gear sleeve useable in the fully variable output hydraulic pump.
Figure 4A:
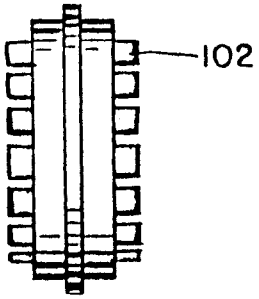

FIGS. 4A and 4B depict a gear sleeve useable as a second or third gear sleeve in accordance with the present invention as depicted in FIG. 1. These gear sleeves comprise ring members having an internal tooth pattern 102 along its inner diameter. The tooth pattern is complimentary to the tooth pattern of the gear inserted therethrough. The gear sleeve may comprise tooth members 102 which protrude axially from a center portion. A gear may be inserted within the gear sleeve such that the teeth of the gear fit perfectly within the tooth pattern 102. The tolerance between the gear sleeve and the gear teeth should be extremely close such that each tooth pattern is complimentary, and in close tolerance with one another. Although the second or third gear sleeves may comprise axially protruding teeth 102, it may be possible to utilize a gear sleeve which does not include such axially protruding teeth 102. In this configuration, the internal tooth pattern exists but the teeth do not extend axially past the main portion of the gear sleeve ring member. Accordingly, the gear sleeves serve to effectively seal oil within the main casing 2 and second casing 46.

Figure 6:
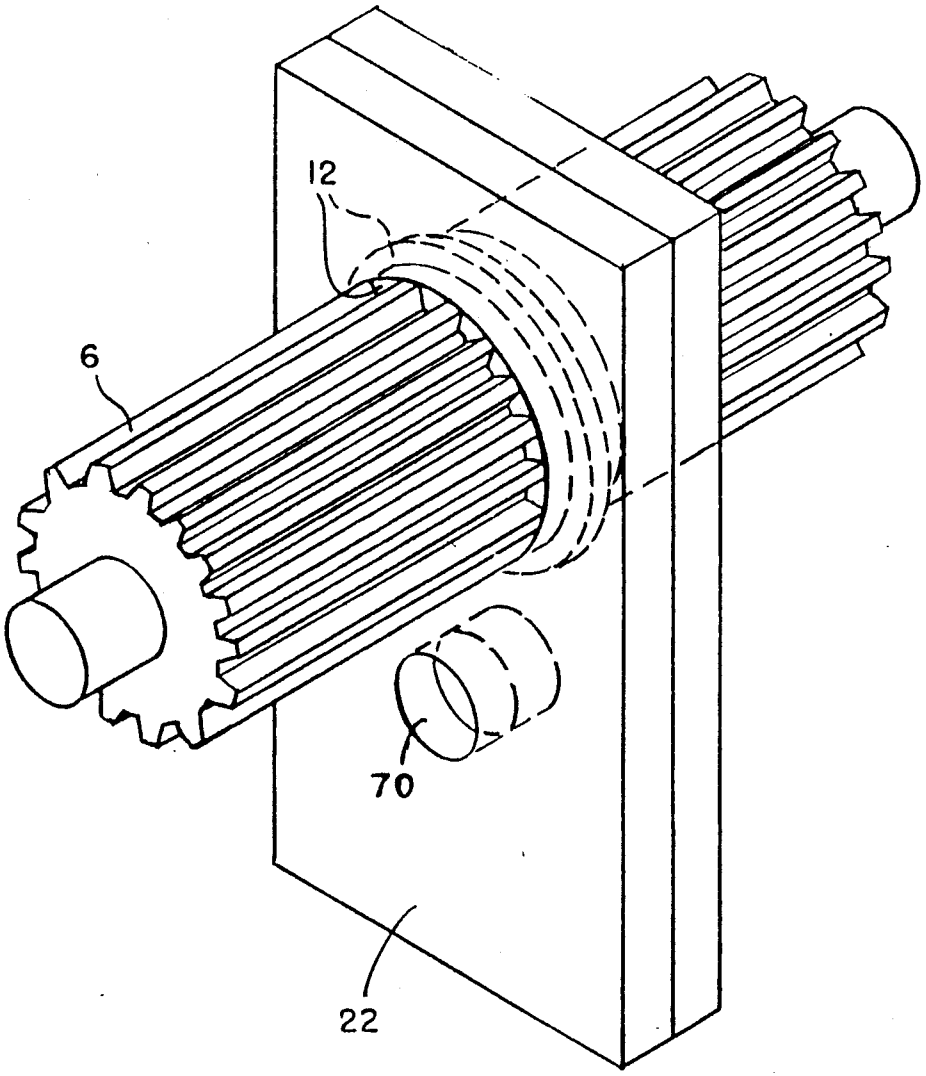
FIG. 6 depicts an isometric view of an end plate useable in the fully variable output hydraulic pump depicted in FIG. 1.

Referring to FIGS. 1 and 6, the first end plate 20 and second end plate 22 are each made of two pieces. The halves of the end plates may be held together by any suitable fastening means. The end plates contain an aperture 70 which acts as a bearing for shaft 3. Also, the end plates contain a cut out portion which receives a gear sleeve 10, 12 therein. The gear sleeve is placed within one half of the end plate prior to attending the second half of the end plate together with the first half. When the gear sleeve is inserted into an end plate 20, 22 the gear sleeve is allowed to rotate relative to the end plate. To facilitate rotation, the gear sleeve may contain a bearing such as a roller type bearing. Also, the gear sleeve may contain a sealing means such as packing or an O-ring. Referring to FIG. 1, the second and third gear sleeves 10, 12 are able to rotate within end plates 20, 22, respectively, and seal oil within the chambers of the main casing 2 and second casing 46.

Figure 5B:
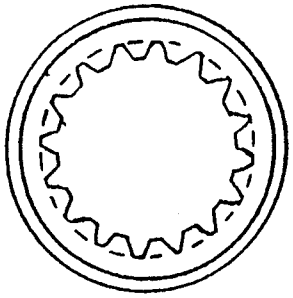
FIGS. 5A and 5B depict yet another gear sleeve useable in the fully variable output hydraulic pump.
Figure 5A:
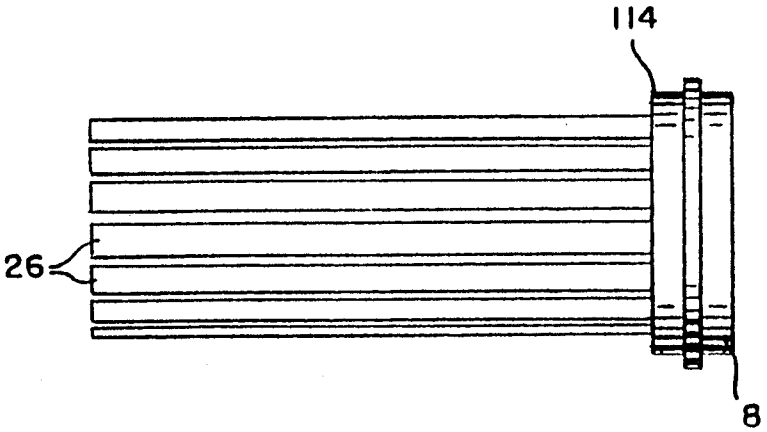

Referring now to FIGS. 5A and 5B, a modified gear sleeve is useable as the first gear sleeve 8, depicted in FIG. 1, which has a plurality of fingers 26 extending axially from the ring portion 114 of the gear sleeve. The ring portion of the gear sleeve has a tooth pattern similar to the tooth pattern of the first and second gear sleeves, discussed supra, wherein the first gear 4, depicted in FIG. 1, may be inserted through the ring portion 114 of the gear sleeve 110. The fingers of the gear sleeve slide directly between the teeth of the first gear such that the outer diameter of the gear at the teeth is the same as the outer diameter of the fingers 112, as depicted in FIG. 3.

Referring again to FIG. 1, the first gear sleeve 8 is positioned along the first gear such that the surface, formed by the teeth of the first gear 4 and the fingers 26 of the first gear sleeve 8, is complimentary to the lower surface formed by the block member 16. As shown in FIG. 3, the area between the block member 16, and the first gear 4 and fingers 26 of the first gear sleeve are such that a close tolerance exists therebetween so as to prevent oil from within the main casing 2 from flowing between the block member 16 and the first gear 4. Accordingly, the first gear sleeve functions to seal oil within the main casing 2. The ring portion 114 of the first gear sleeve 8 may contain a roller bearing means. The roller bearing means may allow the first gear sleeve 8 to rotate within the bearing support assembly 28 such that as the first gear 4 is rotated, the first gear sleeve 8 and fingers also rotate relative to the cylindrically shaped block member 16.

The first, second, and third gear sleeves are each capable of sliding axially relative to the gear member upon which they are mounted. Accordingly, the first gear sleeve 8 is capable of moving axially relative to the first gear 4 and the second and third gear sleeves 10, 12 are capable of moving axially relative to the second gear 6. Since the outer support assembly 18 is connected to the bearing support assembly 28 which houses the first gear sleeve 8, as the outer support assembly 18 is translated by the hydraulic cylinder means 48 the first gear sleeve 8 is also translated the same distance and direction. Also, since the second gear 6 is supported by the outer support assembly 18, the second gear 6 also translates for the same distance as the first gear sleeve 8. Accordingly, the second gear 6, the block member 16, the outer support assembly 18 and the first gear sleeve 8 each translate for the exact same distance and direction relative to the first gear 4, the second gear sleeve 10 and third gear sleeve 12.

As the outer support assembly 18 is moved towards the bearing 25 of the outer casing 14, the area of contact between the first gear 4 and the second gear 6 within the main casing 2 is increased such that the pumping volume within the opening 31 of the main casing is also increased. Conversely, if the outer support assembly is moved in the opposite direction, the area of mesh between the first gear 4 and second gear 6 is decreased such that the pumping volume within the opening of the main casing 2 is also decreased. Therefore, the pumping volume may be effectively altered from zero to a maximum amount. The fluid pumped from the output ports 42, 44 of the main casing 2 may be varied independent of rotation of the first gear 4. The entire pump apparatus may be sized such that there is no area of contact between the first and second gears when the outer support assembly is positioned in the direction opposite the bearing means 25. However, at this position there continues to be contact between the third gear 24 and second gear 6 such that each of the gears continues to be in synchronous rotation. Although the pump may operate without the existence of the third gear 24, this gear enables the second gear 6 to continue rotating when the outer support assembly is moved in a direction opposite bearing 25 of the outer casing 14. At this position, the third gear 24 remains meshed with the first gear 4. This enables the gear teeth of the second gear 6 to mesh with the gear teeth of the first gear 4 when the outer support assembly is translated back towards the bearing means 25.

Fluid within the main casing and second casing is effectively sealed by the end plates 20, 22 and the gear sleeves 8, 10, 12. The close tolerances between the gear teeth and gear sleeves enables the amount of hydraulic fluid which leaks from the casing to be minimized. The contact area between the gear sleeves 10, 12 and the gears 6, 24, and the contact area between the gear sleeves and end plates, which may contain a sealing means, minimize fluid from leaking out of the main casing. Also, the shaft 3 may also contain a sealing means at its bearings within the end plates to minimize leakage. The fluid from within the main casing is also sealed by the contact area between the main casing 2 and fingers 26 of the first gear sleeve 8 as well as the contact area between the main casing 2 and block member 16.

Although the tolerances between contacting members are extremely close, there will still be some measure of leakage of hydraulic fluid from within the pumping volumes of the second casing 46 and main casing 2. However, the entire apparatus may be surrounded by a housing integral with the outer casing 14 as depicted in FIG. 1. Alternatively, the outer casing 14 may not be integral to an outer housing such that a separate outer housing may be used. In either configuration, any leakage of fluid from within the casings, will remain within the outer housing and lubricate the entire pumping system. Accordingly, this leakage will have a minimum effect on the pumping pressure created by the gears within the pumping volume of the second casing 46 and main casing 2.

When the outer support assembly 18 is moved axially in the direction towards the third gear 24 to a maximum point where the area of mesh between the first gear 4 and a second gear 6 is nonexistent, the input ports 40 and 36 and the output ports 42 and 44 may be closed off by the cylinder means 16 such that little or no fluid may enter or exit the main casing. However, the second casing 46 will continue to have fluid pumped therethrough by third gear 24 and second gear 6. Although not shown in the drawings, the second casing may have an outlet port which may be in fluid flow relationship with many of the system's components. For example, this secondary pumping means may continue to operate the hydraulic cylinder 48 as well as cool and lubricate the system's components.

The fully variable output hydraulic pump, as depicted in FIG. 1, can be used as a hydraulic pump for operation of hydraulic cylinders, hydraulic motors and other equipment in all kinds of earth moving, vehicular, and/or air and space applications. The inlet ports 36, 40, 45 may be attached to a hydraulic fluid or oil reservoir by pipes or hoses. Alternatively, any of the inlet ports may be supplied with fluid within outer casing 14 (or outer housing if the outer casing does not encase the system). The output ports may be attached to hydraulic valves, cylinders, motors, etc. using high pressure lines. The pump may operate at maximum efficiency and optimum power at any rotational input of the first gear 4.

Figure 7:
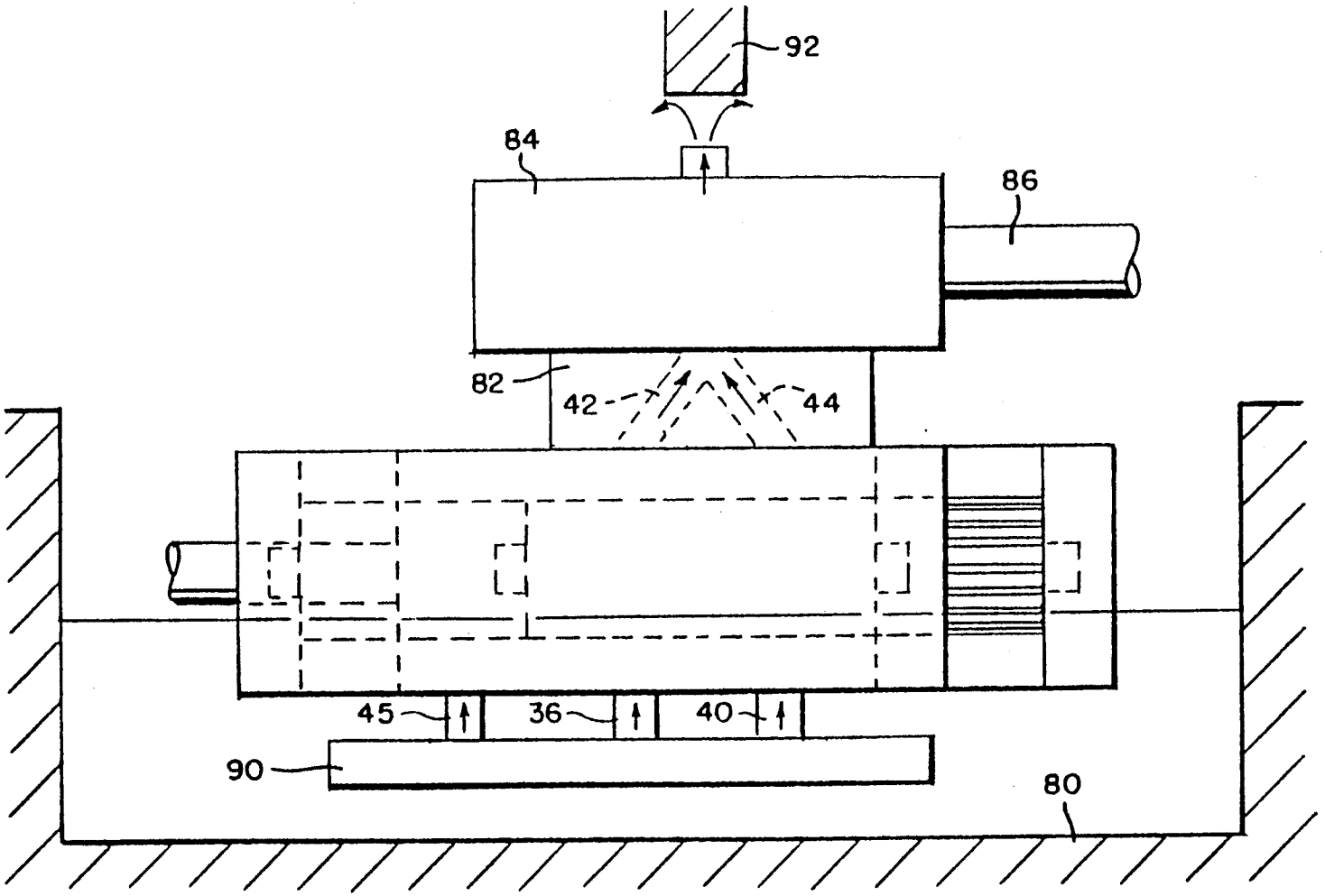
FIG. 7 depicts one application of a fully variable output hydraulic pump depicted in FIG. 1 when used a transmission means.

Other applications for the fully variable output hydraulic pump may also be available. For example, as depicted in FIG. 7, the fully variable output hydraulic pump as shown in FIG. 1 may be used as a part of a transmission of a vehicle. As shown in FIG. 7, the input ports 36, 40, 45 are connected to a filter 90 which is submerged within an outer housing 80 containing hydraulic fluid or oil as depicted by the arrows, the oil is pumped by the fully variable output hydraulic pump through output ports 42 and 44 into a manifold 82 and into a hydraulic motor 84 where the fluid rotates an output shaft 86 which drives the vehicle. The shaft 86 may be connected to a drive shaft. A suction filter 90 is connected to the input ports, 36, 40, 45 such that the oil pumped through the pump is properly filtered. In this manner, the fully variable output hydraulic pump may vary the rotational output of the shaft 86. The outer housing 80 may be of size and shape to surround the fully variable output hydraulic pump 1 and hydraulic motor 84 such that the oil is fully encased therein.

Various means may be used to translate the outer support assembly 18 and thereby control the pump output. For example, hydraulics, manual or mechanical levers, screws, and/or various electromechanical devices or mechanisms may be used. By controlling the position of the hydraulic cylinder 48 (FIG. 1) by a valve, the translation of the outer support assembly 18 can be altered. Referring again to FIG. 7, a hydraulic brake cylinder 92 may be mounted to outer casing 80 or hydraulic motor 84 to obstruct the fluid output which the fluid output from the hydraulic motor. This may add resistance to the system for slowing down the output and rotation of the output shaft which may be desirable in given applications. It would be apparent to those skilled in the art that other systems could be used to regulate the output of fluid, and the invention is not limited to the system depicted herein. If the output shaft is rotated at a rate greater than the flow of fluid from the pump, a one way valve system may be used to allow fluid to be drawn out of a reservoir into the hydraulic motor 86. When used as a transmission, the system may incorporate a set of reversing gears connected to the output shaft 86. The reversing gears may be controlled in conventional methods implemented in standard or automatic transmissions which are well known in the art.

The pump may be used as a transmission in a vehicle as, depicted in FIG. 7. The driver of the vehicle may step on an accelerator pedal to increase the rotation of the input shaft 3. By moving the outer support assembly 18 to increase the amount of fluid which may be pumped, the vehicle may be moved. Initially, the engine speed will start to decrease. A variable speed governor may be used to continue to allow the pumping area within the main casing to open, accelerating the vehicle by increasing the hydraulic motor shaft output 86. Once the vehicle has reached a desired speed, the driver may let off on the accelerator and decrease the rotation of the input shaft 3. The hydraulic cylinder 48 (FIG. 1) would continue to adjust the volume within the main casing such that the output of the hydraulic motor at shaft 86 would allow the governor to maintain the outer support assembly position at the desired location. During deceleration, the governor would adjust the outer support assembly such that the pumping volume within the main casing is decreased which will reduce the output of the hydraulic motor 84 and output shaft 86.

Figure 8:
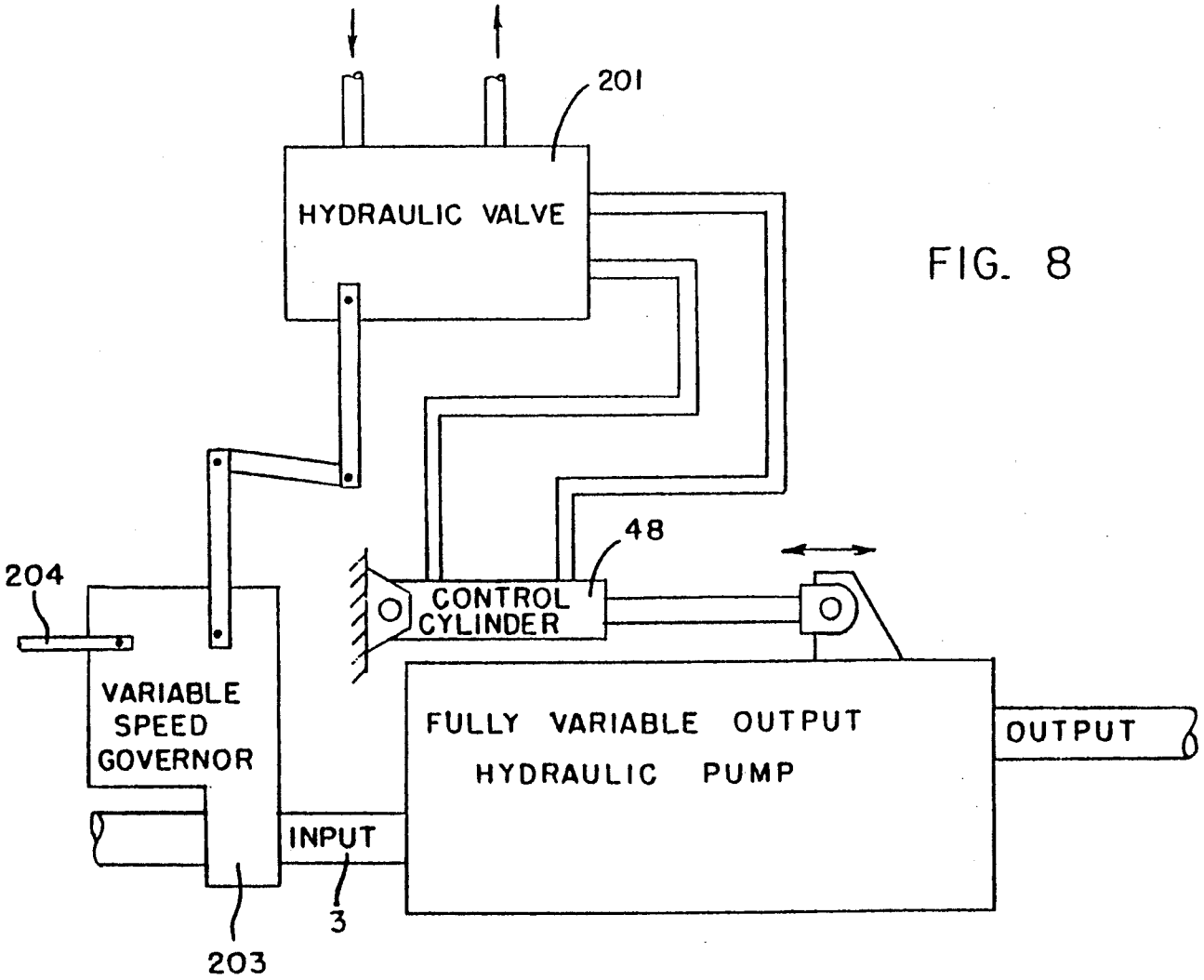
FIG. 8 depicts a hydraulic/mechanical means useable to vary the output of the fully variable output hydraulic pump depicted in FIG. 1.

FIG. 8 depicts a control system for controlling the operation of the fully variable output hydraulic pump by moving the outer support assembly 18. A hydraulic valve 201 controls the movement of a hydraulic cylinder 48. A variable speed governor 203 may be geared off the input shaft 3 so that the governor is controlled by the rotation of input shaft 3 and the accelerator 204 of the vehicle. The governor 203 would activate the hydraulic valve 201. The valve would adjust the pump to increase pumping capacity if the input shaft rotation is rising above the optimum speed at a given throttle position. The variable speed governor 201 would operate the valve so as to move the hydraulic cylinder 48 in the opposite direction to decrease the pumping capacity of the pump 1 if the input shaft 3 speed is less than the normal optimum loaded speed at the particular throttle position.

Figure 9:
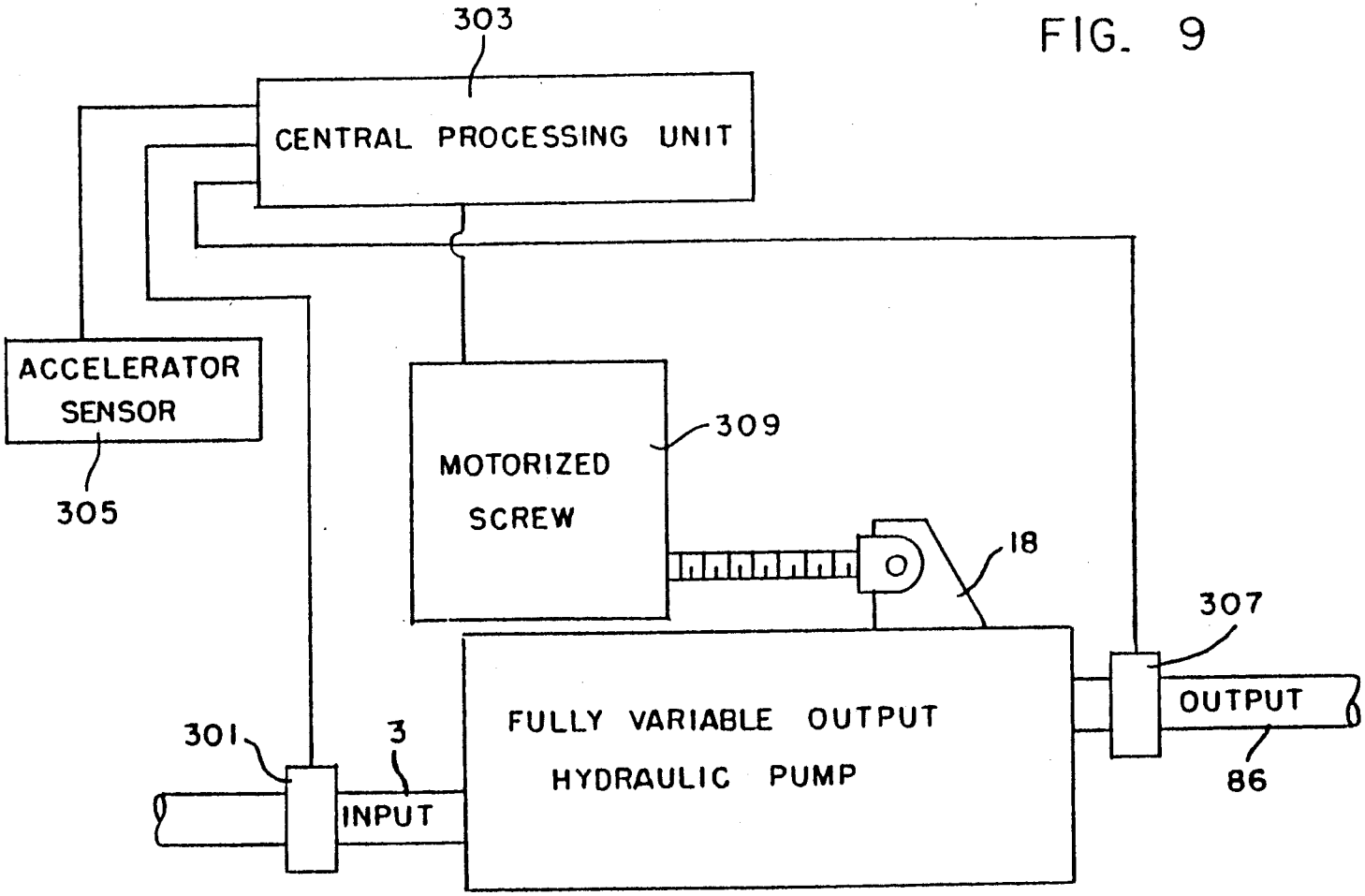
FIG. 9 depicts an electrical control system useable to vary the output of the fully variable output hydraulic pump depicted in FIG. 1.

FIG. 9 depicts an electronic control system for a transmission utilizing the fully variable output hydraulic pump 1. An input speed sensor 301 monitors the rotation of the input shaft 3 and sends a signal to a central processing unit 303. An accelerator position sensor 305 detects the position of the accelerator and sends a signal representative of the same to the central processing unit 303. An output speed sensor 307 senses the speed of the output shaft 86 and sends a representative signal to the central processing unit 303. The central processing unit then sends a signal to a means for changing the position of the outer support assembly 18 such as a motorized screw 309. The central processing unit may also receive information such as vehicle travel grade as well as engine speed, vehicle speed and accelerator position. The central processing unit may have information such as optimum engine power and rotational input shaft speeds stored in memory in order to determine the most efficient or optimum control assembly position during a particular driving condition.

Although the invention has been described in conjunction with the embodiments depicted herein, it is apparent to one skilled in the art that the invention is not limited thereto. Various modifications, substitutions, and equivalents may be implemented within the embodiment depicted in FIG. 1 without departing in any way from the spirit of the invention. Any such modifications are intended to be within the scope of the invention as defined by the following claims.

What is claimed is:

1. A fully variable output hydraulic pump comprising:

a main casing having openings at axially opposite ends of the main casing and an interior fluid pumping chamber extending axially therethrough, one or more input ports extending radially through the casing into the fluid pumping chamber and one or more output ports extending radially through the casing into the fluid pumping chamber, said fluid pumping chamber being cylindrically shaped to receive a pair of meshed cylindrically shaped gears inserted axially therein;

a first cylindrically shaped elongate rotatable gear;

a second cylindrically shaped elongate rotatable gear, said first and second rotatable gears being meshed and inserted within the fluid pumping chamber wherein the main casing surrounds the meshed first and second gears;

means for rotatably supporting said first gear;

means for axially translating and rotatably supporting said second gear within the main casing, said means for axially translating and rotatably supporting said second gear being axially translatable relative to the means for supporting said first gear; and means for sealing the area between each of said gears and the main casing thereby effectively sealing fluid within the fluid pumping chamber.

2. The fully variable output hydraulic pump of claim 1 wherein said means for axially translating and rotatably supporting said first gear comprises an outer casing having one or more bearing means engaged thereto.

3. The fully variable output hydraulic pump of claim 2 wherein the means for sealing the area between each of the gears and the main casing comprises a gear sleeve means, said gear sleeve means configured to allow one of said rotatable gears to be axially insertable therein.

4. The fully variable output hydraulic pump of claim 3 wherein said first gear is inserted within a first gear sleeve and said second gear is inserted within a second gear sleeve.

5. The fully variable output hydraulic pump of claim 4 wherein the first gear sleeve has a plurality of finger members extending axially therefrom, said finger members being insertable between the teeth of said first gear.

6. The fully variable output hydraulic pump of claim 5 wherein the means for axially translating and rotatably supporting the second gear comprises a block member having a bearing means therein for supporting said second gear, said block member being insertable within the main casing of the fluid pumping chamber and having a lower concave surface having a radius of curvature complimentary to the curvature of the first rotating gear wherein said lower surface of said block member is mounted upon said first gear.

7. The fully variable output hydraulic pump of claim 6 wherein the means for axially translating and rotatably supporting the first gear further comprises an end plate mountable to said outer casing, said end plate capable of receiving said second gear sleeve therein, said second gear sleeve having said second gear inserted therethrough, wherein said second gear sleeve and said second gear are rotatable relative to said end plate.

8. The fully variable output hydraulic pump of claim 7 wherein the means for axially translating and rotatably supporting the second gear further comprises an outer support assembly having a bearing means engaged thereto.

9. The fully variable output hydraulic pump of claim 8 further comprising a third rotatable gear mounted to rotate synchronously with the first gear, said third gear being in mesh with the second gear to continuously drive said second gear synchronously.

10. The fully variable output hydraulic pump of claim 9 further comprising a second casing having a fluid pumping chamber extending therethrough and having a fluid input port and fluid output port wherein the third and second gears are in mesh and inserted through the second casing.

11. The fully variable output hydraulic pump of claim 10 further comprising means for sealing fluid within the second casing.

12. The fully variable output hydraulic pump of claim 11 wherein the means for sealing fluid with the second casing comprises a third gear sleeve rotatably mounted within a second end plate.

13. The fully variable output hydraulic pump of claim 4 wherein the second gear sleeve comprises a ring member having a tooth pattern on its inner diameter, said tooth pattern being complimentary to the teeth of said second gear wherein said second gear is in close tolerance with said second gear sleeve when inserted therein.

14. A fully variable output hydraulic pump comprising:

a main casing having a fluid pumping chamber extending therethrough, one or more input ports and one or more output ports, said fluid pumping chamber being shaped to receive a meshed pair of cylindrically shaped gears inserted axially therein;

an outer casing means surrounding the main casing, said outer casing means for supporting a gear therein and having one or more bearing means engaged thereto;

a first cylindrically shaped elongate rotatable gear supported at a first end by said bearing means, said first gear being inserted through the main casing;

a first end plate supported by the outer casing, said end plate having a second bearing means for a second end of the first rotatable gear;

a first gear sleeve configured to allow the first rotatable gear to be axially insertable and slidable therein, said first gear sleeve having a plurality of finger members extending axially therefrom, said finger members being insertable between the teeth of the first gear, said first gear sleeve being supported within a bearing support assembly means and being rotatable within said bearing support assembly;

an outer support assembly having said bearing support assembly means engaged thereto at a first end, said outer support assembly being engaged to a third bearing means at a second end;

a second cylindrically shaped elongate rotatable gear supported at a first end by the third bearing means affixed to the second end of the outer support assembly, said second gear having a diameter which allows its teeth to be in close tolerance with inner surface of the fluid pumping chamber when the first gear is inserted into the main casing;

a block member having a lower concave portion resting on the finger members and gear teeth of the first gear, said block member having a fourth bearing means therein for supporting the second end of the second gear, said first gear being configured wherein both the block member and first gear are insertable within the fluid pumping chamber such that the teeth of the first gears are in close tolerance with the inner wall of the fluid pumping chamber;

a second gear sleeve configured to allow the second gear to be axially insertable and slidable therein, said second gear sleeve being rotatably supported within said first end plate wherein as said second gear rotates said second gear sleeve rotates within the first end plate;

means for translating the outer support assembly relative to the outer casing in the direction parallel to the axial direction of the gears wherein as said outer support assembly is translated said second gear, block member bearing support assembly and first gear sleeve are displaced in the same direction relative to the first and second gear thereby varying the axial distance in which the teeth of the first and second gear mesh to vary the amount of fluid which may be pumped through the fluid pumping chamber of main casing.

15. The fully variable output hydraulic pump of claim 14 further comprising:

a third rotatable gear mounted to synchronously rotate with the first gear, said third gear being in mesh with second gear to continuously drive said second gear synchronously.

16. The fully variable output hydraulic pump according to claim 15 further comprising a second casing having a fluid pumping chamber extending therethrough and having a fluid input port and fluid output port wherein the third and second gears are in mesh and inserted through said second casing such that the teeth of the gears are in close tolerance with the fluid pumping chamber.

* * * * *